US005778750A

United States Patent [19]

Drzewiecki et al.

[11] Patent Number: 5,778,750

[45] Date of Patent: Jul. 14, 1998

[54] LEVER-OPERATED PUSH FLAP FOR MANUAL PUNCH

[75] Inventors: James J. Drzewiecki, Arlington Heights; Michael J. D'Amore, Lake Villa, both of Ill.

[73] Assignee: Acco Brands, Inc., Lincolnshire, Ill.

[21] Appl. No.: 598,057

[22] Filed: Feb. 7, 1996

Related U.S. Application Data

[63] Continuation of Ser. No. 270,186, Jul. 1, 1994, abandoned.

[51] Int. Cl.[6] ..... B26F 1/02

[52] U.S. Cl. ..... 83/628; 83/633; 83/687

[58] Field of Search ..... 83/628, 691, 597, 83/588, 626, 549, 563, 167, 633, 634, 686, 687

[56] References Cited

U.S. PATENT DOCUMENTS

| | | | |
|---|---|---|---|
| 145,578 | 12/1873 | Leach | 83/633 |
| 332,666 | 12/1885 | Laney | 83/633 |
| 909,285 | 1/1909 | Denburger . | |
| 1,158,499 | 11/1915 | Hoffman | 83/633 |
| 1,174,883 | 3/1916 | McLuckie | 83/633 |
| 1,197,934 | 9/1916 | Heeter . | |
| 2,275,012 | 3/1942 | Faas . | |
| 2,382,523 | 8/1945 | Unger . | |
| 2,405,150 | 8/1946 | Kern . | |
| 3,485,130 | 12/1969 | Neustadter et al. . | |
| 4,166,404 | 9/1979 | Almog | 83/633 |
| 4,656,907 | 4/1987 | Hymmen . | |
| 4,898,055 | 2/1990 | Neilsen | 83/549 |
| 5,163,350 | 11/1992 | Groswith, III et al. . | |

FOREIGN PATENT DOCUMENTS

| | | | |
|---|---|---|---|
| 2021935 | 5/1970 | Germany | 83/633 |
| 136042 | 12/1919 | United Kingdom . | |

*Primary Examiner*—Kenneth E. Peterson
*Attorney, Agent, or Firm*—Pennie & Edmonds LLP

[57] ABSTRACT

A manual sheet paper punch having an elongated pivotal flap which drives punch dies to punch sheets and, in addition, a pivotal lever positioned above the flap for hand operation to urge the elongated flap downwardly to punch sheets. Increased mechanical advantage is accomplished.

4 Claims, 8 Drawing Sheets

LEVER-OPERATED PUSH FLAP FOR MANUAL PUNCH

This is a continuation of application Ser. No. 08/270,186, filed Jul. 1, 1994, now abandoned.

BACKGROUND OF THE INVENTION

Prior manual punches have included a handle and a pressure plate to accomplish perforating paper sheets (U.S. Pat. No. 2,382,523). Extended longitudinal handles have also been proposed for hand punches (U.S. Pat. No. 5,143,502). Punching machines have also included toggle arrangements (U.S. Pat. No. 806,262).

SUMMARY OF THE INVENTION

Broadly, the present invention comprises a cam lever arrangement for applying force to the push flap of a manual punch. The flap pivotal about an axis on the punch is acted on through cam engagement by a cam lever means also pivotally mounted on the punch to increase the mechanical forces acting on the punches while allowing a reduction in the force required by the user. The punch includes a non-scuffing sliding chip scrap slipper.

It is a feature that the cam lever means may be pivotal about an axis parallel or perpendicular to a flap pivot axis.

It is a further feature that chip scraps from the hole punching operation may be removed from the punch assembly without the need for removing the slipper.

It is still a further feature that the punch assembly has a cam feature, integral to the push flap which allows operation of the punch pins by a rolling cam action rather than flat sliding surfaces thus eliminating the squeak associated with prior art.

DESCRIPTION OF THE PREFERRED OF THE EMBODIMENTS

Figure 1A:
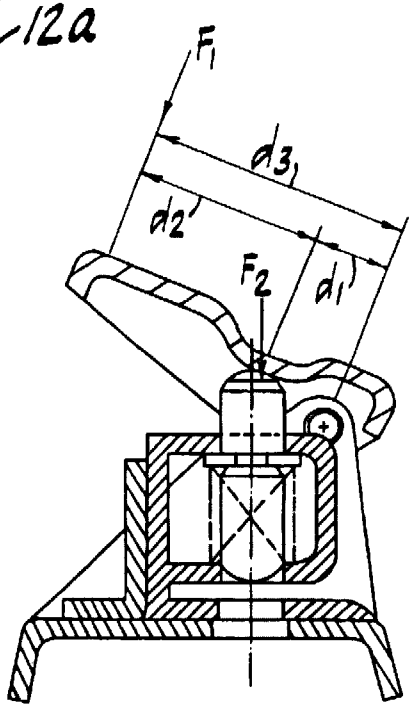
FIG. 1A PRIOR ART
Fig. 1*a* is a cross sectional view of the prior art showing lever distances.
Figure 1:
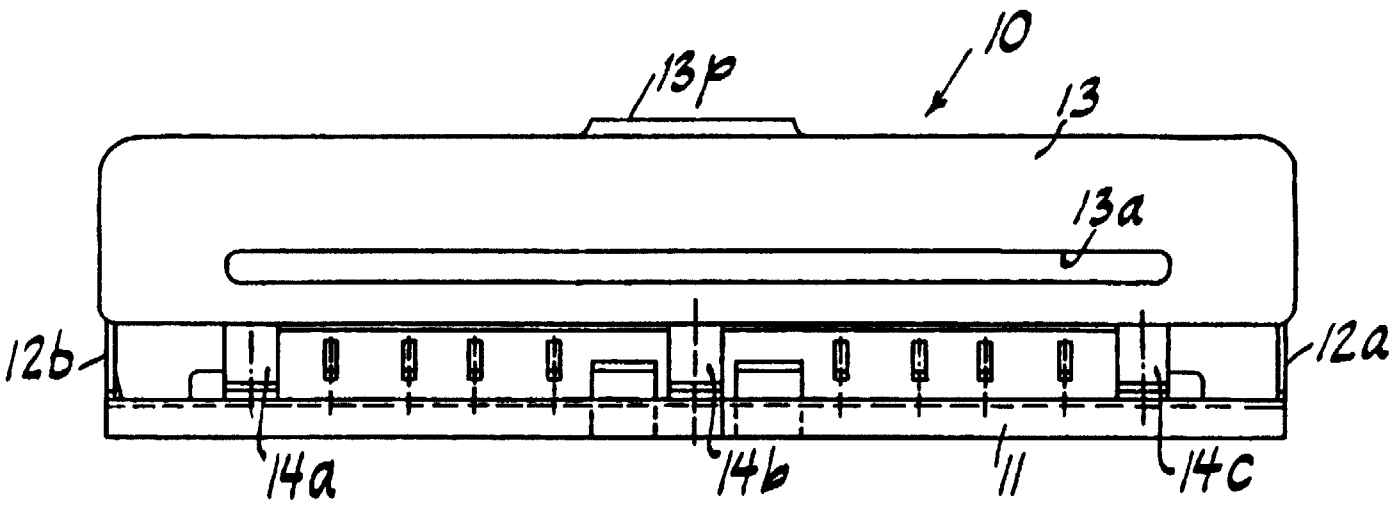
FIG. 1 PRIOR ART
FIG. 1 is a front view of a prior art punch having its flap raised.
Figure 2:
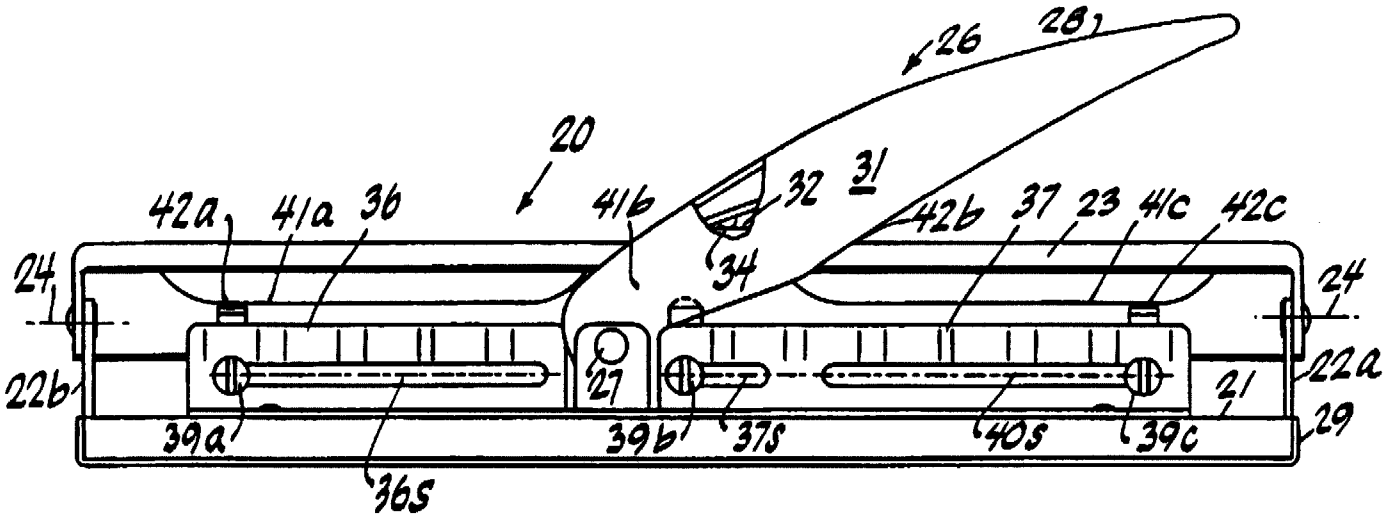
FIG. 2 is a back view of a slippered punch of the present invention with the flap raised and including a cam lever arrangement in its raised position.

In FIG. 1 prior art punch 10 has rectangular base 11, vertical end walls 12*a*, 12*b* and pivotal flap 13 having indentation 13*a*. Also shown are three (3) pin units 14*a*, 14*b*, 14*c* and flap protrusion 13*p*. Turning to FIG. 1*a*, the mechanical advantage of the prior art unit 11 is shown by the following:

$$d_3 = 1.5 \text{ INCH } Typ.$$

$$d_2 = 1 \text{ INCH } Typ.$$

$$d_1 = .5 \text{ INCH } Typ.$$

$$\frac{d_3}{d_1} = \frac{1.5}{.5} = 3{:}1 \text{ RATIO}$$

Turning to FIGS. 2–5, inventive paper sheet punch 20 has base 21, vertical end walls 22*a*, 22*b*, pivotal elongated flap 23 pivotal about flap axis 24, punch pin cams 41*a*, 41*b*, 41*c*, sliding slipper 29 and flap cam surface 32. Lever 26 includes hand-contact portion 28, neck portion 31, curved cam surface 34 (FIG. 2) makes a sliding line contact with flap cam surface 32 of flap 23 as lever 26 is operated to move pivotal elongated flap 23 (see FIGS. 4 and 5). Lever 26 is shaped and positioned for rotation so it fits within the area of rectangular base 21 as viewed from above. Lever 26 adds to the height of the punch but not its width or length. Also shown are punch unit racks 36, 37 with horizontal slots 36*s*, 37*s* and 40*s* for longitudinally adjustable pin units 39*a*, 39*b*, 39*c* which carry punch pins 39*p*.

Figure 3:
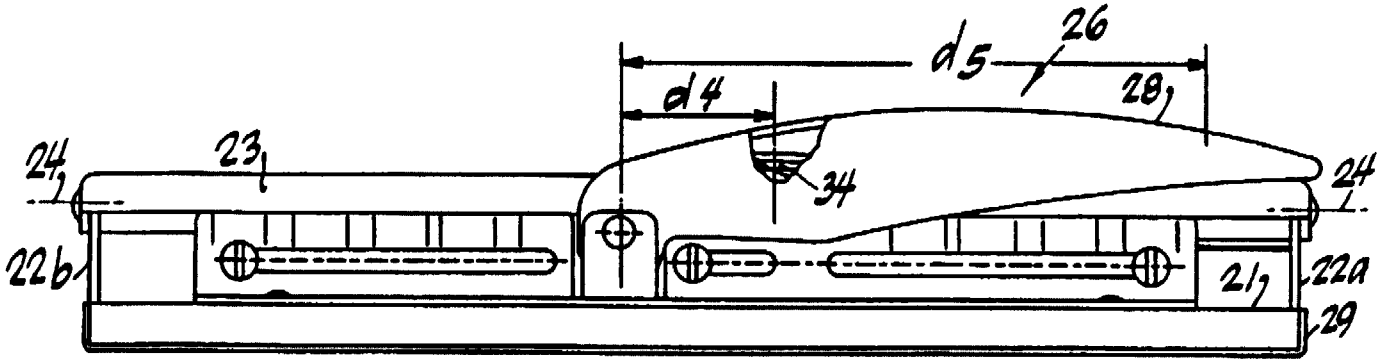
FIG. 3 is the same view as FIG. 2 with the cam lever arrangement and flap lowered.
Figure 5:
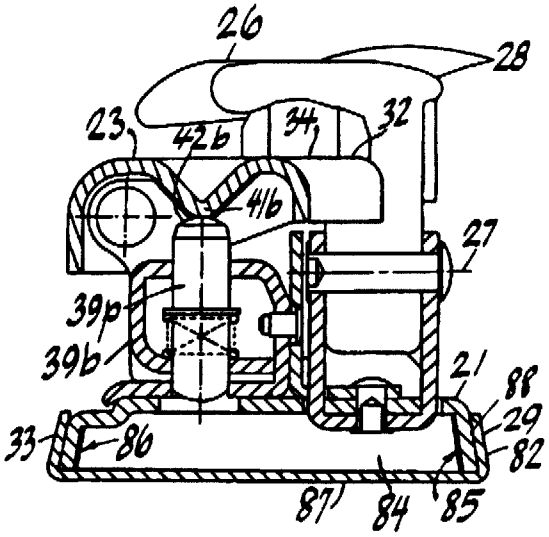
FIG. 5 is the same view as FIG. 4 with the lever and flap lowered.
Figure 4:
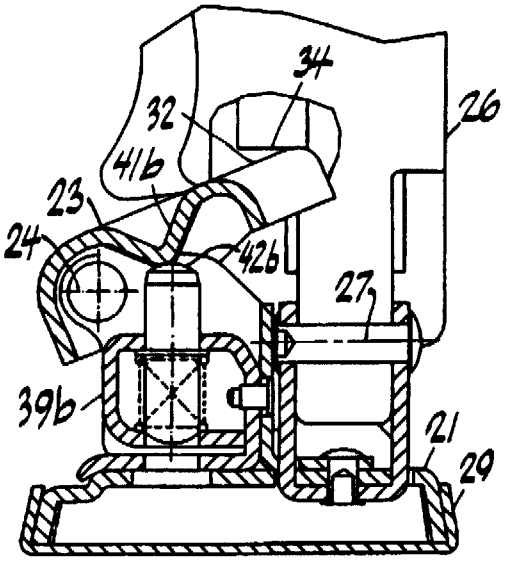
FIG. 4 is an end view of the punch with a portion shown in section and with the lever and flap raised.
Figure 10:
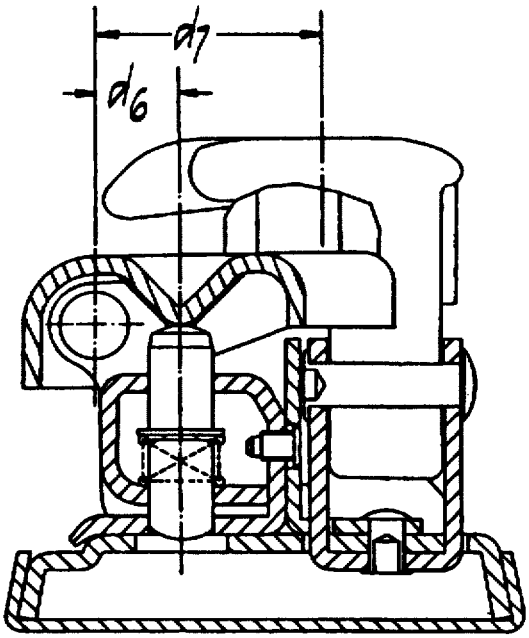
FIG. 10 is the same view as FIG. 7 with the lever lowered and specific lengths shown.

With reference to FIGS. 3 and 10 and lever arm distances:
Mechanical Advantage Lever Design $$d_4 = 1.447$$

$$d_5 = 4.470$$

$$d_6 = .380$$

$$d_7 = .887$$

$$\frac{d_5}{d_4} = \frac{5.47}{1.447} = 3.78{:}1 \text{ RATIO}$$

$$\frac{d_7}{d_6} = \frac{.887}{.380} = 2.33{:}1 \text{ RATIO}$$

ADVANTAGE 2.33×3.78=8.807

Figure 8:
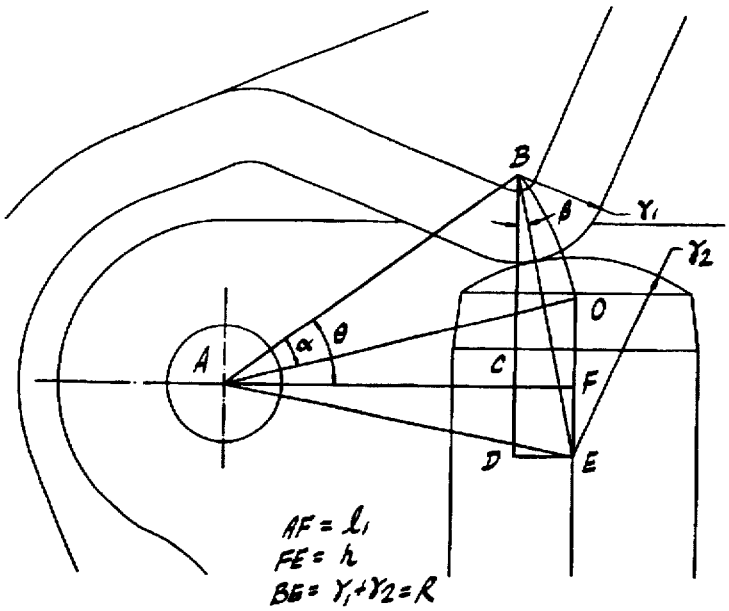
FIG. 8 is an enlarged area of FIG. 7 with dimensions and angles therein.
Figure 9:
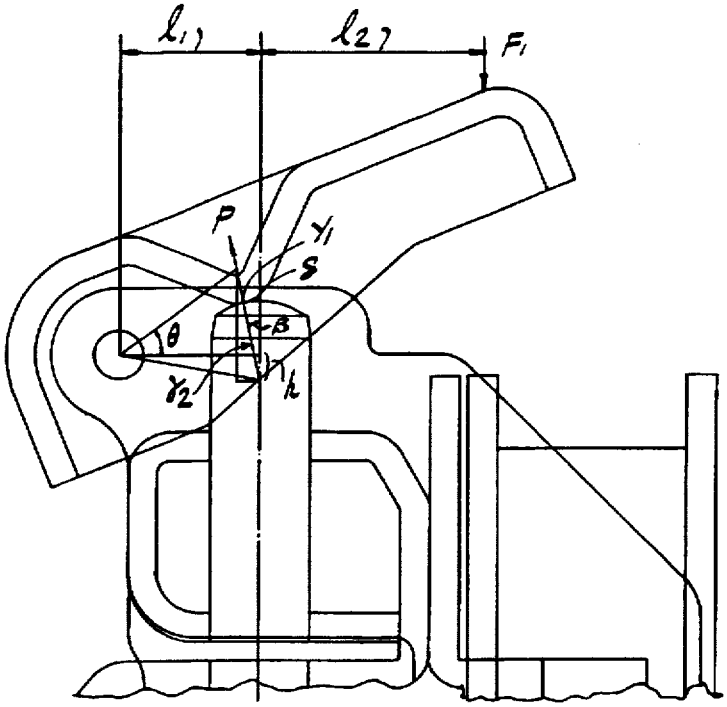
FIG. 9 is an enlarged area of FIG. 6 with dimensions and angles therein.

As curved cam surface 34 of lever 26 operates on flat cam surface 32 of flap 23 remote from axis 24 the mechanical advantage is based on the following equations (FIGS. 8 and 9):

EQUATION SET 1

$$<BAE = \cos - 1 \frac{AB^2 + AE^2 - BE^2}{2 \cdot AB \cdot AE}$$

where $$AB = \sqrt{AF^2 + FO^2} = \sqrt{l_1^2 + \gamma_1^2}$$

$$AE = \sqrt{AF^2 + FE^2} = \sqrt{l_1^2 + \lambda_1^2}$$

-continued $$BE = R = \gamma_1 + \gamma_2$$

$$<\theta AF = tg^{-1}\frac{\gamma_1}{l_1}$$

$$<FAE = tg^{-1}\frac{\lambda}{l_1}$$

$$\theta = <BAE - <FAE$$

$$\alpha = <BAE - <FAE - <OAF$$

$$AC = AB \cdot \cos\theta$$

$$DE = AF - AC = l_1 - AB\cos\theta$$

$$BD = \sqrt{BE^2 - DE^2} = \sqrt{R^2 - DE^2}$$

$$\cos\beta = \frac{BD}{BE} = \frac{\sqrt{R^2 - (l_1 - AB\cos\theta)}}{R}$$

$$\delta = \gamma_1 \cdot \cos\beta$$

EQUATION SET 2

First Stage:

$$(l_1 - \delta)p\cos\beta = (l_1 + l_2)F_1$$

$$F_1 = \frac{(l_1 - \delta)}{(l_1 + l_2)} \cos\beta \cdot P = G_1 \cdot P$$

where $P$ is Punch Force $$G_1 = \frac{(l_1 - \delta)}{(l_1 + l_2)} \cos\beta$$

$l_1$, $l_2$, $\delta$, $\beta$ are geometric realted factor (see page 2)

Second Stage:

$$l_3F_2 = (l_3 + l_4)F \text{ input}$$

$$F_2 = \frac{l_3 + l_4}{l_3} F \text{ input} = \frac{1}{G_2} F \text{ input}$$

where $F$ input is input force $$G_2 = \frac{l_3}{l_3 + l_4}$$

$\because F_1 = F_2$, Combined (1) and (2), we obtain $$F \text{ input} = G_1 \cdot G_2 \cdot P$$

During operation integral cam surfaces 41*a*, 41*b*, 41*c* of flap 23 being a radius surface rather than a flat angled surface operate upon surface 42*a*, 42*b*, 42*c* of pin units 39*a*, 39*b*, 39*c* in a rolling action rather than an sliding action. The result being a punch in which the squeak common to current designs is eliminated.

Figure 6:
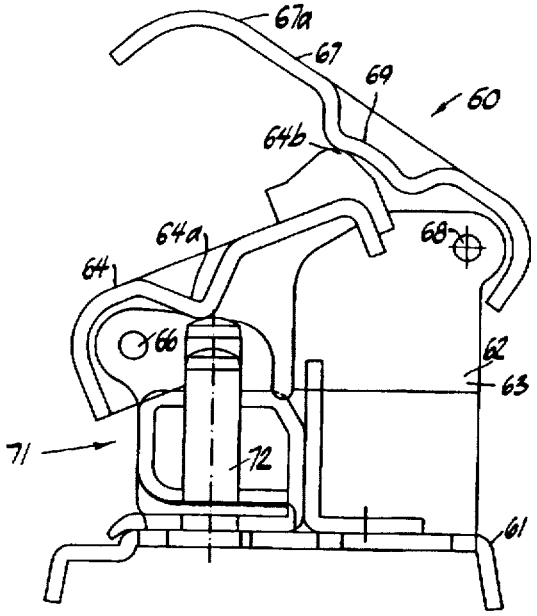
FIG. 6 shows an alternative embodiment having a raised lever arrangement mounted at the punch ends about axes parallel to the length of the punch.
Figure 7:
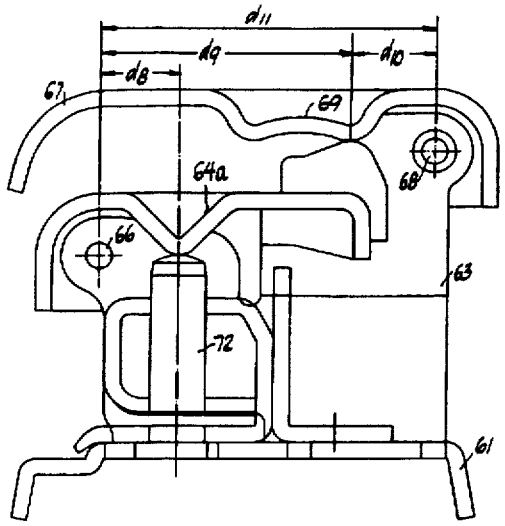
FIG. 7 is the same view as FIG. 6 with the lever lowered.

Turning to FIGS. 6 and 7 and an alternative embodiment, punch 60 has base 61, end frame pieces 62, 63, flap 64, flap pivot 66, lever 67 and lever pivot 68. Flap 64 includes cam 64*a* adjacent to pivot 66 and remote cam 64*b*. Lever 67 includes cam 69 and remote surface 67*a*.

FIG. 7 shows lever arm distances:

| | | |
|---|---|---|
| $d_8$ | = | .380 |
| $d_9$ | = | 1.200 |
| $d_{10}$ | = | .400 |
| $d_{11}$ | = | 1.560 |
| $\frac{d_9}{d_8}$ | = | $\frac{1.200}{.380}$ = 3.158:1 RATIO |
| $\frac{d_{11}}{d_{10}}$ | = | $\frac{1.560}{.4}$ = 3.9:1 RATIO |
| $3.158 \times 3.9$ | = | 12.316 |

Figure 11:
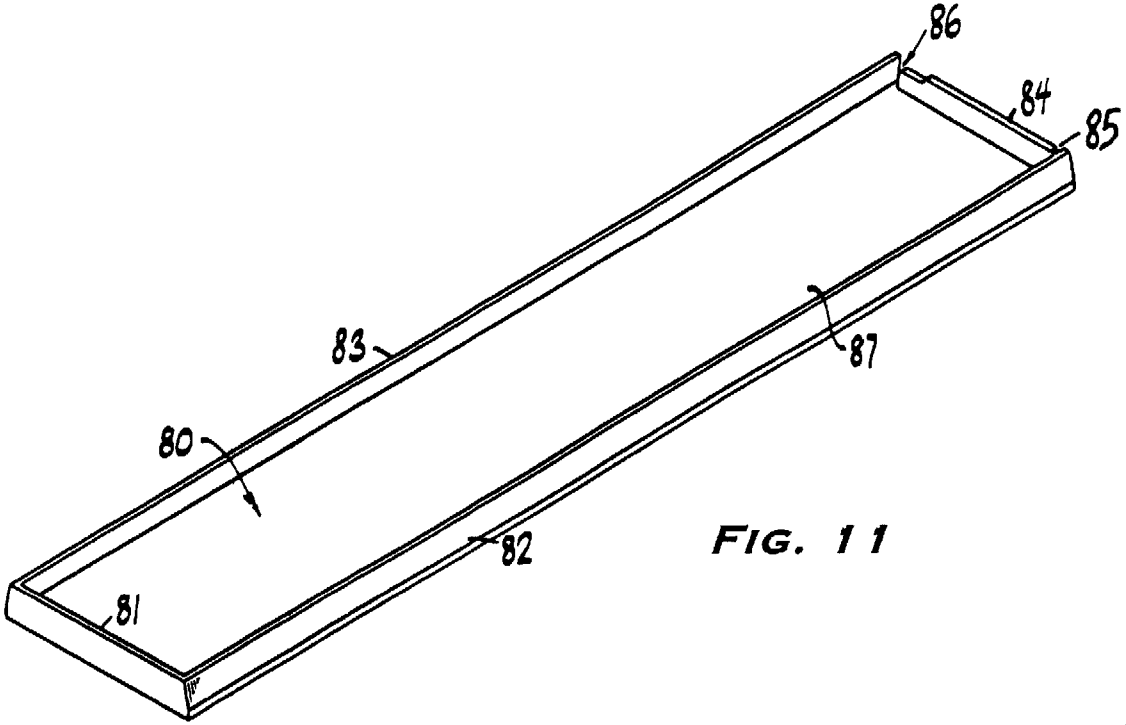
FIG. 11 is a perspective view of the chip slipper showing the various elements.
Figure 12:
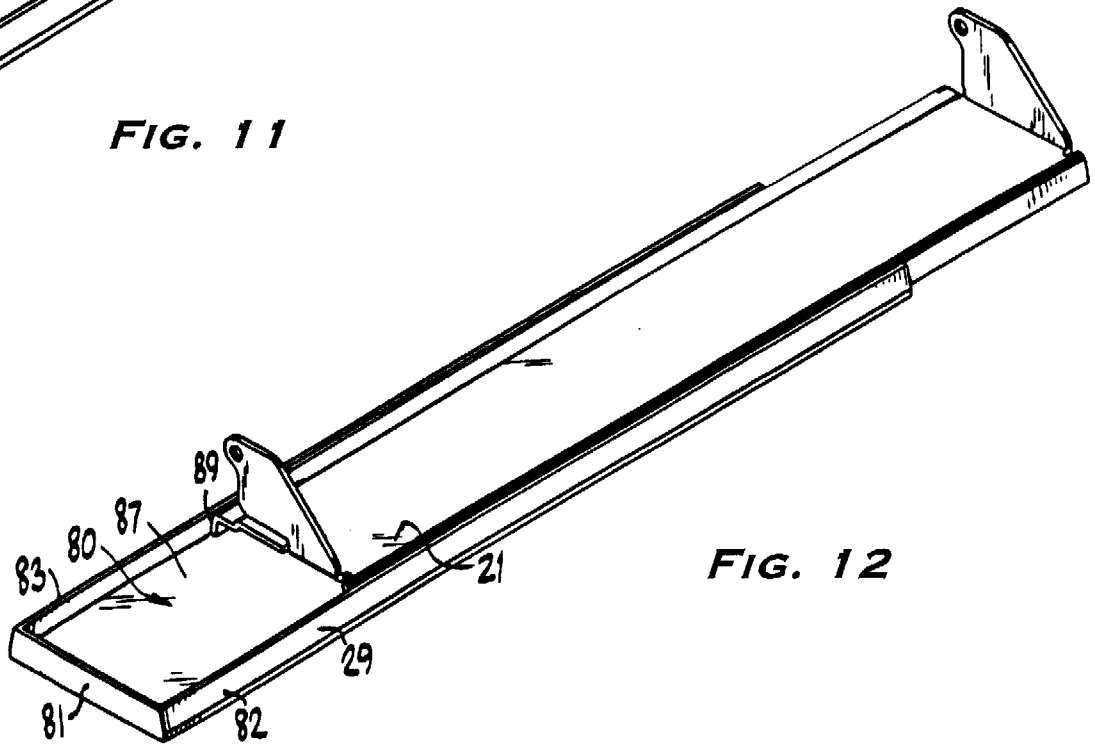
FIG. 12 is a view of the punch base with the slipper shown partially extended.

Turning to FIGS. 11 and 12 construction and operation of the slipper 29 are shown including channel area 80, closed end 81, angled sides 82, 83, notched end 84 and slots 85, 86 and bottom surface 87. Slipper 29 is made of rubber, plastic or other material that will not scratch or mar a finished wooden desk or similar surface.

Slipper 29 may be extended to a position so the paper chips can be poured free from the slipper holding channel 80. Movement of the slipper 29 from the captive position shown in FIGS. 2 and 3 to the pouring position is accomplished by sliding the slipper 29 in a direction opposite from end 84. Slipper 29's retention on base 21 is accomplished forming angled sides 82, 83 of slipper 29 to complement the angled sides 88, 89 of base 21.

Figure 13:
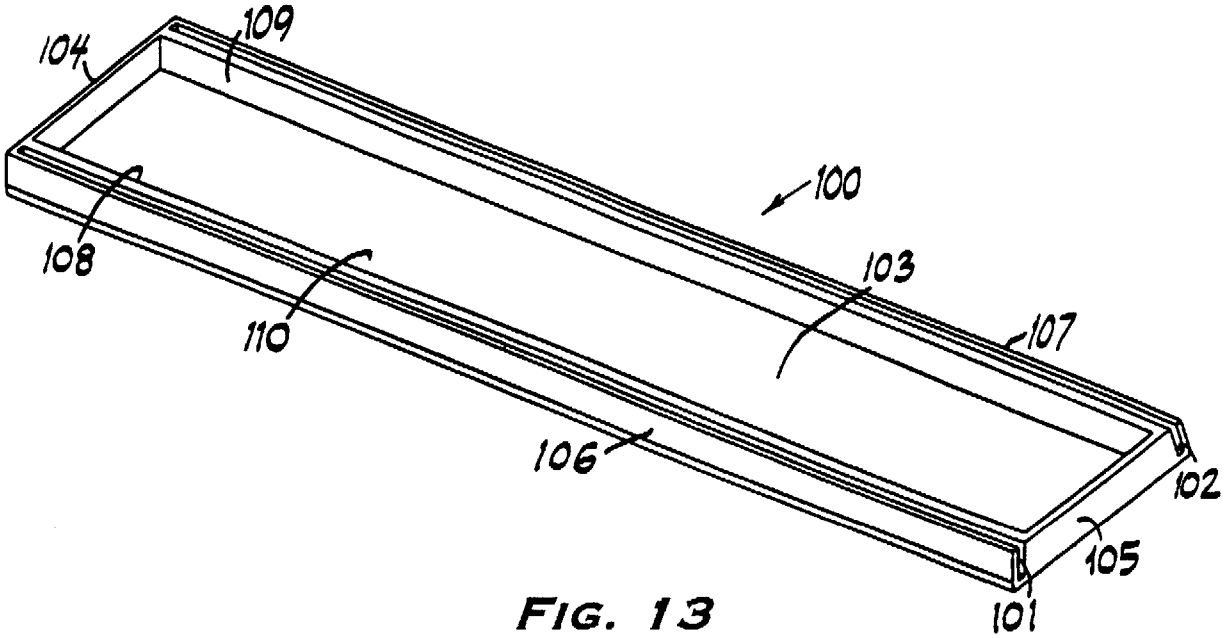
FIG. 13 is a perspective view of an alternative slipper.
Figure 13A:
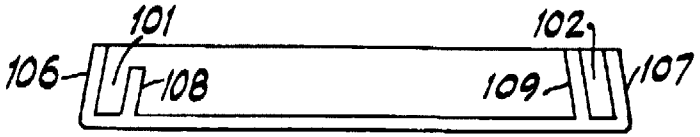
FIG. 13*a* is a sectional view taken through FIG. 13.

Turning to FIGS. 13 and 13*a* and the alternative embodiment of slipper 100 which includes channels 101 and 102, cavity 103, closed ends 104, 105, angled sides 106, 107, inner angled surfaces 108, 109, and bottom surface 110. Channels 101, 102 may terminate at closed end 104 or closed end 104 may be slotted like end 105 to all channels 101, 102 to continue to the outer surface of end 104.

We claim:

1. In a manual paper sheet punch having a base, an elongated flap pivotal about a flap axis, which flap has an upper cam surface, the improvement comprising:

a) said flap having a first portion adjacent the flap axis and a second portion remote from the flap axis, which second portion includes said upper cam surface;

b) a plurality of spaced apart pins for punching paper sheets, said pins being positioned below the flap for engagement with said first portion of said flap at a pin engaging location defined by said first portion; and c) cam lever means mounted on a lever axis fixed on the punch, said axis lever extending perpendicular to said flap axis, said cam lever means including:

i) a first surface spaced from said lever axis to which a punch operating force is applied to move said lever means, and ii) a second surface disposed between said lever axis and said first surface and positioned for cam engagement with said upper cam surface of the second portion of the flap, whereby movement of the lever means about its lever axis by said force applied to said lever means causes the flap to pivot about said flap axis to punch paper sheets.

2. The paper punch of claim 1 in which the base has a rectangular area and cam lever means is positioned within such area as viewed from above.

3. The paper punch of claim 1 in which the flap has a convex surface and each of said pins has a convex surface, which flap convex surface and pin convex surface engage during punching.

4. The manual punch of claim 1, wherein:

a) said first portion of said flap is spaced from the flap axis by a first distance and said second portion is spaced from the flap axis by a second distance greater than said first distance;

b) said plurality of spaced apart pins are disposed below said flap for engagement by said first portion of said flap at said pin engaging location under a first force for punching paper; and c) said cam lever means is mounted on said lever axis with said second portion of said flap and said second surface of said lever means being spaced from said lever axis by a third distance and with said first surface of said lever means being spaced from said lever axis by a forth distance greater than said third distance, said cam lever means being fixed on the punch for cam engagement of said second surface with the upper cam surface of the second portion of the flap upon movement of the lever means about its lever axis in response to a second force applied to said first surface of said lever means to cause the flap to pivot to punch paper sheets, with the first, second, third and fourth distances being related to each other to produce said first force against the punch pins at a level over eight times said second force applied to the lever means.

* * * * *